US005358335A

United States Patent [19]

LaFleur

[11] Patent Number: 5,358,335

[45] Date of Patent: Oct. 25, 1994

[54] BULK BAG WITH CONICAL TOP

[75] Inventor: Lee LaFleur, Manistee, Mich.

[73] Assignee: Custom Packaging Systems, Inc., Manistee, Mich.

[21] Appl. No.: 71,460

[22] Filed: Jun. 1, 1993

[51] Int. Cl.[5] ..... B65D 30/10

[52] U.S. Cl. ..... 383/107; 383/24; 383/120; 383/907

[58] Field of Search ..... 383/104, 107, 120, 121, 383/24, 907

[56] References Cited

U.S. PATENT DOCUMENTS

| | | | |
|---|---|---|---|
| 3,105,617 | 10/1963 | Felldin | 383/67 X |
| 4,301,848 | 11/1981 | Beaven et al. | 383/24 X |
| 4,479,243 | 10/1984 | Derby et al. | 383/121 X |
| 4,596,040 | 6/1986 | LaFleur et al. | 383/7 |
| 4,781,472 | 11/1988 | LaFleur et al. . | |
| 4,781,475 | 11/1988 | LaFleur . | |
| 4,790,029 | 12/1988 | LaFleur et al. . | |
| 4,798,572 | 1/1989 | LaFleur et al. . | |
| 4,953,987 | 9/1990 | Schnaars | 383/75 X |
| 5,087,235 | 2/1992 | LaFleur . | |
| 5,104,236 | 4/1992 | LaFleur . | |
| 5,127,893 | 7/1992 | LaFleur . | |

*Primary Examiner*—Allan N. Shoap
*Assistant Examiner*—Jes F. Pascua
*Attorney, Agent, or Firm*—Barnes, Kisselle, Raisch, Choate, Whittemore & Hulbert

[57] ABSTRACT

A reinforced collapsible bag and method of making it from a tubular blank of a flexible material which when filled has two pair of opposed sidewall panels and an inturned shoulder bordering the top of the sidewalls for supporting another bag stacked vertically thereon in a stable manner. The blank is constructed by collapsing it into a generally flat unit having a pair of overlying panels with a pair of folded gusset panels received therebetween, overlapping and securing together adjacent upper corners of adjacent panels, and inverting and expanding the blank to form a blank having two pairs of opposed sidewalls and an inturned shoulder bordering the top of the sidewalls. When expanded, the bag has a bottom wall which extends inwardly from the bottom edge of the sidewalls. A top wall having an inlet opening is attached to the upper shoulder and is of a generally frustoconical shape to ensure more even and complete filling of the bag. Preferably, to facilitate filling, the bag has an inlet spout encompassing the inlet opening that is attached to the top wall.

7 Claims, 2 Drawing Sheets

BULK BAG WITH CONICAL TOP

FIELD OF THE INVENTION

This invention relates to shipping and storage containers, and more particularly to a collapsible container in the form of a bag of a flexible woven material and a method of making it.

BACKGROUND OF THE INVENTION

Previously, many granular products and some liquids have been shipped and stored in large bulk bags which may contain as much as a ton or more of material. Some of these bags are flexible and when emptied can be folded to a generally flat condition. Examples of such flexible bags are disclosed and claimed in U.S. Pat. Nos. 4,596,040, 4,781,472, 4,781,475, 4,790,029, 4,798,572, 5,087,235, 5,104,236, and 5,127,893.

These flexible bags have generally rectangular sidewalls and a substantially flat top wall so that when filled the bags can be stacked one on top of another. For some applications, the bags are made of a woven fabric and for other applications, a plastic material. For some uses, and particularly for storing liquids, a bag or liner of a water impervious plastic material is received in and reinforced and protected by a bag of a woven fabric. Usually, these bags have a spout in one or both of ends for filling and emptying the bag.

A prior known bag, disclosed in U.S. Pat. No. 4,953,987, has a truncated cone-shaped top wall to facilitate filling and an iris-type closure in the top wall for tightening the top and sidewalls of the bag around bulk material within the bag to produce a bulk bag which can support another bag vertically stacked. The cone-shaped top wall is attached to the top edges of four sidewalls which are connected to each other at their side edges. The bag construction disclosed also has a bottom wall connected to the bottom edges of the sidewalls and an inlet spout attached adjacent the truncated portion of the top wall.

The iris-type closure is constructed of a cord received in an annular channel in the top wall. In use, the cord is tightened to inwardly constrict the top wall fabric around the truncated portion to flatten the top wall tightly against the bulk material within the bag. As the closure is tightened, excess bag fabric is gathered, preventing the formation of loose pockets of sidewall fabric which makes the bag more stable for receiving another bag stacked on top. Unfortunately, a bag of this construction must be substantially completely filled for the closure to gather enough top wall fabric to effectively tighten the bag around the bulk material. Should the bag be incompletely filled or improperly leveled, loose pockets of sidewall fabric still may form which can cause the bag to slump, buckle or topple possibly damaging or spilling the contents of the bag or another bag vertically stacked.

Another problem with this bag construction is that adjacent sidewall panels are connected along side edges which can lead to premature bag failure. Any weakness in any line of connection between panels can cause the bag to rupture when another bag is placed on top. Similarly, should the bag, when supporting another bag on its top, slump or bulge because it was incompletely filled, the resultant uneven distribution of stress in the sidewall panels can cause the underlying bag to burst along one of its side edges.

SUMMARY OF THE INVENTION

A collapsible bag for receiving bulk material which includes a tubular blank having a circumferentially continuous sidewall portion with an inturned shoulder bordering the top of the sidewall, a bottom wall which extends inwardly from the bottom edges of the sidewall, and a generally frustoconical top wall attached about its periphery to the shoulder. Preferably, to facilitate filling the bag, the bag has a tubular inlet spout attached to the top wall.

When the bag is expanded, such as when filled, the bag has two pairs of opposed sidewall panels with a generally planar bottom wall and a generally frustoconical top wall. When empty, the bag may be collapsed for shipping or storing the bag or to facilitate disposal of the bag. To produce a bag of collapsible construction, the blank, bottom wall, top wall and inlet spout are constructed of a flexible material such as a woven fabric of polypropylene or polyethylene. Preferably, the blank is seamlessly formed of one piece of flexible woven fabric having a circular knit weave construction for producing a bag that possesses uniform burst strength and which allows printing or other indicia to be applied easily and without distortion to the blank.

In one preferred embodiment, the bag is constructed from a blank having a circumferentially continuous central sidewall with inturned shoulders bordering the top and bottom of the sidewall. In preparing the blank, the blank is collapsed along longitudinally extending fold lines into a compact generally flat unit having a pair of overlying panels with a pair of folded gusset panels received therebetween. While collapsed, adjacent upper and lower corners of adjacent panels are secured together so that they remain overlapped, preferably by stitching the blank at an angle along each overlapped corner. In forming the shoulders, the blank is inverted by turning it inside out and expanded by folding the gusset panels outwardly and separating the overlying panels from each other. As the blank is expanded, each pair of stitched, overlapped corners pull a band of material along the top and bottom edges of the blank inwardly to form respectively the upper and lower shoulders. When fully expanded, the blank forms a bag sidewall of generally rectangular cross section having two pairs of opposed sidewall panels and upper and lower shoulders bordering the sidewall panels.

In a second preferred embodiment, the bag is constructed of a modified blank that, when expanded, has an integral bottom wall opposite the upper shoulder. Fold lines which run longitudinally along the blank and diagonally along the bottom wall permit the blank to be collapsed into a compact configuration having a pair of overlying generally pentagonal gusset panels with a pair of folded generally pentagonal panels received therebetween. To form the upper shoulder, adjacent upper corners of adjacent panels are secured in the overlapped condition and the blank is inverted and expanded drawing a band of material along the top edge of the blank inwardly. When fully expanded, the blank forms a bag sidewall of generally rectangular cross section having two pairs of opposed sidewall panels with an inturned shoulder bordering the top of the panels and an integral generally planar bottom wall.

When filling a bag of either construction, the frustoconical shape of the top wall directs granular material into the bag corners while allowing the bag to be filled above the top edges of the sidewall panels for substantially completely filling the bag when the material within the bag is leveled. When filling is complete, the bag assumes a free-standing, self-supporting generally rectangular or cubical configuration which can be placed side-by-side with other bags and receive another bag stacked on top. The inturned shoulder construction maintains the generally rectangular cross sectional shape of the bag, even with another bag stacked on top, maximizing the number of bags of this invention that can be stacked side-by-side in a given area. The upper shoulder helps support and distribute the weight of a stacked bag in a stable manner, even if the lower bag is not completely filled. Additionally, the upper shoulder construction seals against the bottom of the bag above to retain the contents of the bag below.

Objects, features and advantages of this invention are to provide a bulk bag and method of making it which utilizes a frustoconical top wall for efficient and complete filling of the bag; is formed of a tubular blank of one piece flexible seamless construction having uniform burst strength characteristics and which can easily receive printing or other indicia without distortion; has an inturned shoulder bordering the top of the blank which maintains the generally rectangular cross sectional contour of the bag for efficient side-by-side placement, stabilizes the bag for receiving another bag on top, seals against the bottom wall of the stacked bag, allows a lighter weight more inexpensive top wall material to be used, and protects the seam attaching the top wall to the blank; is of collapsible construction for easy and efficient shipping, storage or disposal; is readily and easily adapted to the mass production of bags; and is of relatively simple, economical and reliable manufacture of bags.

BRIEF DESCRIPTION OF THE DRAWINGS

These and other objects, features and advantages of this invention will be apparent from the following detailed description, appended claims, and accompanying drawings in which:

DETAILED DESCRIPTION

Figure 1:
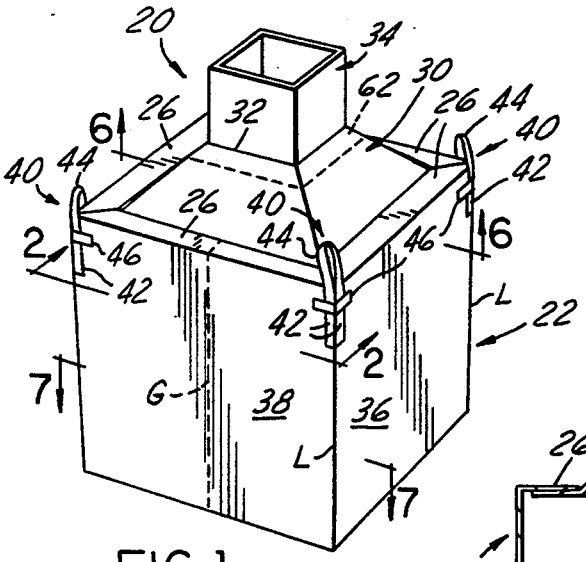
FIG. 1 is a perspective view of a collapsible bag of this invention.

Referring in more detail to the drawings, FIG. 1 illustrates a collapsible bulk bag 20 embodying this invention of generally rectangular cross section which is constructed of a tubular blank 22 having a generally circumferentially continuous sidewall 24 and an inturned shoulder 26 bordering the top of the blank 22 for supporting another bag (not shown) vertically stacked upon bag 20 in a stable manner. The bag 20 has a bottom wall 28 which extends inwardly from the bottom edge of the sidewall 24. To ensure more complete filling of the bag 20, a generally frustoconical top wall 30 having an inlet opening 32 therein is attached to the shoulder 26 of the blank 22. Preferably, a tubular inlet spout 34 which encompasses the inlet opening 32 is attached to the top wall 30 to facilitate filling the bag 20. If desired, the bottom wall 28 may have an attached outlet spout (not shown) encircling an outlet opening (not shown) in the wall 28 to permit the bag 20 to be controllably emptied.

In the preferred construction depicted in FIG. 1, the bag 20 is of a generally rectangular or cubical configuration when expanded, and when empty is collapsible into a generally flat condition. The sidewall 24 of the blank 22 is formed with two opposed generally flat panels 36 and two opposed gusset panels 38 such that the bag 20 assumes a generally rectangular cross sectional shape when filled and when empty is easily folded or collapsed into a flat unit for shipping or storage. To produce a bag 20 of collapsible construction, the tubular blank 22, bottom wall 28, top wall 30 and spout 34 are constructed of a flexible material such as a woven fabric of polypropylene or polyethylene. Preferably, the sidewall 24 of the blank 22 is of seamless construction for producing a bag 20 with desirable and uniform burst strength characteristics and that allows printing or other indicia to be applied to the bag 20 without being distorted by a seam. Preferably, the blank 22 is constructed of one piece of flexible woven fabric having a seamless circular knit weave construction. If a leakproof container is required, a liner of a liquid-impervious film such as polyethylene having a conforming shape can be received in the bag 20.

If desired, straps 40 can be provided for lifting and moving the bag 20. Preferably, each strap 40 is constructed of a flexible material having a pair of legs 42 which are connected to the upper corners of adjacent panels 36, 38 of the blank 22 and a loop 44 which extends above the panels for receiving a tine of a forklift truck. Preferably, each leg 42 of each strap 40 is connected to the blank 22, such as by a series of stitches. A binding 46 may be laterally fastened across both legs 42 of each strap 40 and to adjacent panels 36, 38 of the blank 22 to further anchor each strap 40 to the bag 20.

Figure 2:
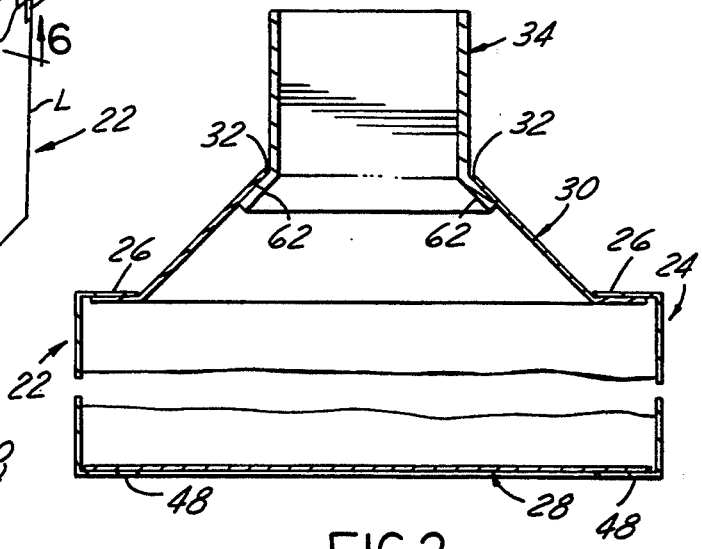
FIG. 2 is a fragmentary sectional view of the bag of FIG. 1 taken along line 2—2.
Figure 4:
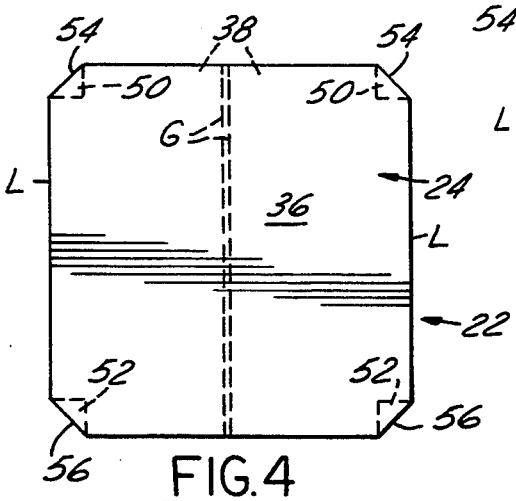
FIG. 4 is a top plan view of the tubular blank of FIG. 3 after it has been inverted.
Figure 5:
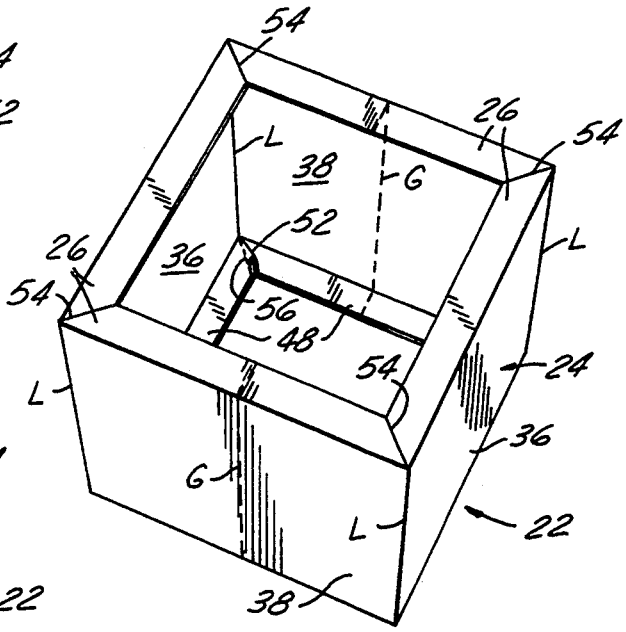
FIG. 5 is a perspective view of the tubular blank after it has been inverted and expanded illustrating an inturned shoulder bordering the top of the blank and an inturned shoulder bordering the bottom of the blank.

As is shown in FIGS. 2 and 5, the blank 22, when expanded, has an inturned top shoulder 26 encircling and bordering the sidewall 24 and preferably a similar inturned bottom shoulder 48. To form the blank 22, it is collapsed into a compact generally flattened configuration (FIG. 3) and each pair of adjacent upper corners 50 and lower corners 52 adjacent each pair of adjacent panels 36 and 38 are overlapped and secured together along lines 54 and 56 such as by stitches. To form the inturned shoulders 26 and 48, the blank 22 is inverted (FIG. 4) and expanded (FIG. 5) such that the overlapped and secured corners 50 and 52 draw the top and bottom of the blank 22 inwardly.

Figure 3:
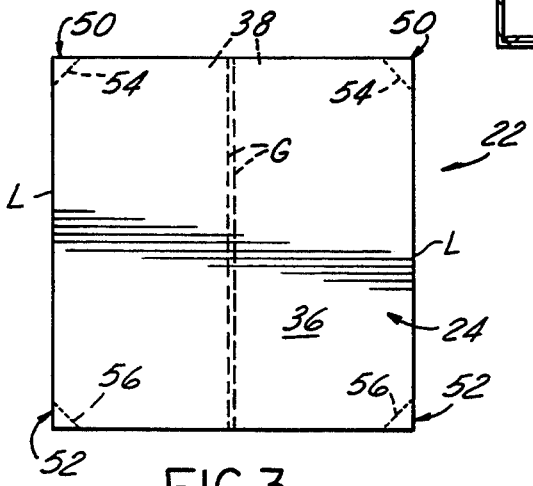
FIG. 3 is a top plan view of a tubular blank for making a bag of this invention shown folded in a compact collapsed configuration.

FIG. 3 illustrates a blank 22 collapsed in the compact condition for connecting it together along the lines 54 and 56. The collapsed blank has the flat panels 36 overlying each other with the gusset panels 38 folded and received therebetween. To enable the blank 22 to be collapsed, two pairs of fold lines L, only one pair of which is shown, extend longitudinally from top to bottom of the blank 22 defining the side edges between adjacent panels 36, 38. Each gusset panel 38 has a longitudinally extending fold line G (shown in phantom) generally bisecting each gusset panel 38, permitting each gusset panel 38 to be folded over itself for being received between the flat panels 36.

While the blank 22 is collapsed, the adjacent upper corners 50 of adjacent panels 36, 38 are overlapped and secured together. Preferably, each pair of adjacent upper corners 50 are secured along a line of of connection 54 (shown in phantom) that is inclined at an angle (of about 45° as shown) relative to the top and side edges of adjacent panels 36, 38. Preferably, each pair of adjacent upper corners 50 are secured by stitching the corners 50 together to create a seam along the line of connection 54, although the corners 50 could be joined by a heat seal, adhesive means or in another manner. Similarly, each pair of adjacent lower corners 52 of adjacent panels 36, 38 are joined together, preferably by stitching along a line of connection 56 (shown in phantom) inclined at an angle (again, about 45° as shown) to the bottom and side edges of adjacent panels 36, 38.

In forming the inturned upper 26 and lower 48 shoulders, the blank 22 as depicted in FIG. 3 is inverted as shown in FIG. 4 by turning it inside out such that the interior surface of each panel 36, 38 is turned outwardly to the exterior. As the blank 22 is inverted, each seam 54, 56 draws an associated pair of overlapped corners 50, 52 (shown in phantom) inwardly, disposing each pair of corners 50, 52 and the stitching of each seam 54, 56 within the blank 22. After being inverted, fold lines L and G permit the blank 22 to be again collapsed into a compact configuration as shown in FIG. 4. When inverted and collapsed, the upper and lower corner portions of each panel 36, 38 appear to be truncated along each seamline of connection 54, 56.

As is illustrated in FIG. 5, the blank 22 of FIG. 4 is expanded by unfolding the gusset panels 38 outwardly and separating the flat panels 36 from each other. As the blank 22 is expanded, each upper seam 54 pulls a band of material along the top of the blank 22 inwardly to form the upper shoulder 26 and each lower seam 56 pulls a band of material along the bottom of the blank 22 inwardly to form the lower shoulder 48. When fully expanded, the fold lines L form side edges dividing the circumferentially continuous sidewall 24 into two pairs of opposed sidewall panels 36, 38 with the upper shoulder 26 bordering the top of the panels 36, 38 and the lower shoulder 48 bordering the bottom of the panels 36, 38.

When expanded as illustrated in FIG. 5, each seam 54, 56 of the upper 26 and lower 48 shoulders extends diagonally inwardly from an end of an adjacent fold line L gathering the fabric at each pair of overlapped corners 50, 52 of each shoulder 26, 48 which reinforces the generally rectangular cross sectional shape of the blank 22, especially when the bag 20 is filled with bulk material. As is exemplified by the portion of the interior surface of the lower shoulder 48 visible in FIG. 5, each gathering of overlapped material 50, 52 is disposed within the blank 22 for producing a bag 20 having a pleasing aesthetic exterior appearance while preventing each gathering 50, 52 from snagging an object which lies outside of the blank 22. However, if a shoulder having a substantially level interior surface is desired, the overlapped corner portions 50, 52 may be severed from the blank 22 and removed.

Figure 7:
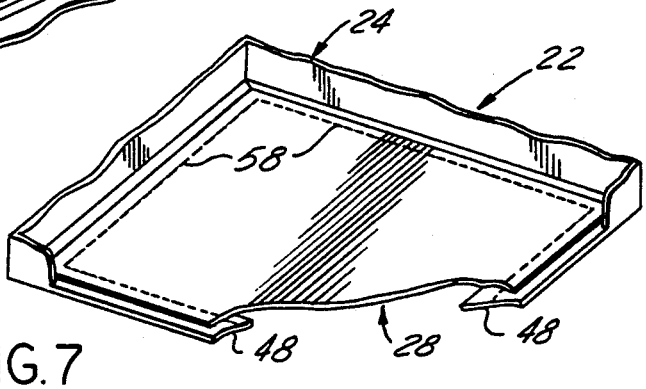
FIG. 7 is a fragmentary perspective view of the bottom of the bag taken along line 7—7 of FIG. 1.

As is illustrated more clearly in FIGS. 2 and 7, the bottom wall 28 is formed of a separate piece of generally rectangular material which is secured around its periphery to the bottom shoulder 48 of the blank 22. To prevent the outer edges of the wall 28 from snagging an object outside the blank 22 and possibly rupturing the bag 20, the bottom wall 28 is preferably placed with its outer boundary in overlapping engagement against the interior surface of the shoulder 48 and secured around its periphery to the blank 22 by stitching along a line of connection 58 shown in FIG. 7. As a result of the lower shoulder construction 48, a bottom wall 28 of a less expensive lighter weight material can be used.

Figure 6:
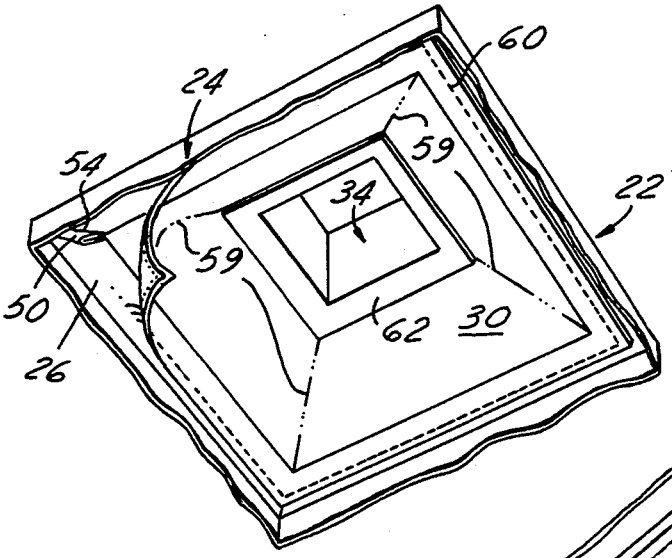
FIG. 6 is a fragmentary perspective view of the top of the bag taken along line 6—6 of FIG. 1.

As is shown in FIGS. 2 and 6, the top wall 30 is constructed of a separate piece of generally rectangular material that preferably has the inlet opening 32 generally centrally located therein. To impart the generally frustoconical shape to the top wall 30, it preferably has four circumferentially spaced apart pleats 59 which radiate outwardly from adjacent the inlet opening 32 to an outside edge of the top wall 30. Preferably, this results in a top wall with four interconnected generally trapezoidal panels. To secure the top wall 30 to the tubular blank 22, the wall 30 is placed in overlapping fashion against the upper shoulder 26 and preferably stitched or otherwise attached thereto along a line of connection 60 about the periphery of the top wall 30. Preferably, the top wall 30 is overlapped with and placed against the interior surface of the upper shoulder 26 to prevent an object exterior of the bag 20 and engaging an outer edge of the top wall 30 from possibly tearing seam 60 and/or rupturing the bag 20.

The inlet spout 34 is constructed of a separate piece of preferably tubular material that is secured to the top wall 30 around the periphery of the inlet opening 32. To secure the spout 34 to the top wall 30, the spout 34 is telescopically received through the inlet opening 32 with an outwardly flared section 62 at one end of the spout 34 placed in overlapping engagement against the interior surface of the top wall 30 and secured thereto around the periphery of the inlet opening 32 by stitching or other means of attachment.

Figure 9:
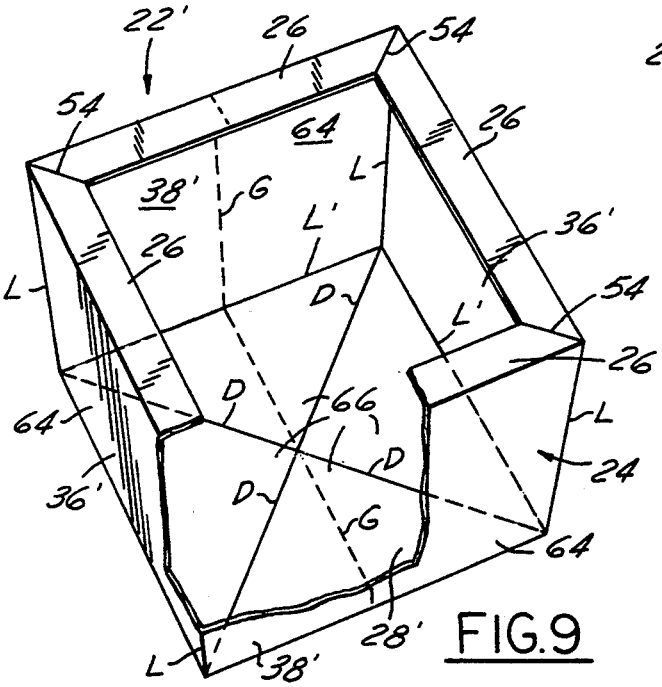
FIG. 9 is a perspective view of an expanded tubular blank of FIG. 8 broken away to illustrate the bottom wall construction.
Figure 8:
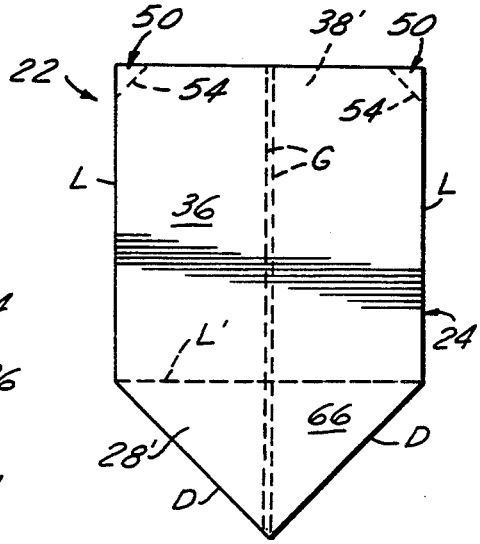
FIG. 8 is a top plan view of a second tubular blank embodiment having an integral bottom wall and shown folded in a compact collapsed configuration.

FIGS. 8 and 9 illustrate a modified form of a tubular blank 22′ which, when expanded, has a circumferentially continuous sidewall portion 24, an inturned shoulder 26 bordering the top of the sidewall 24 and a generally planar bottom wall 28′ at the bottom of the blank 22′. Blank 22′ is essentially the same as that produced using the blank 22 illustrated in FIGS. 2–7 except that the bottom wall 28′ is integral with the blank 22′ eliminating the separate bottom wall 28 attached to the lower inturned shoulder 48 of blank 22.

The tubular blank 22′ is shown in FIG. 8 in a collapsed compact configuration having a pair of overlying generally pentagonal flat panels 36′ with a pair of folded pentagonal gusset panels 38′ received therebetween. Fold lines L divide sidewall 24 into adjacent panels 36′, 38′ and when expanded define the side edges of four generally rectangular sidewall panels 64. To form a collapsible bottom wall 28′, a pair of fold lines D which extend diagonally along the bottom wall 28′ and interconnect the ends of diagonally opposed side edge fold lines L, divide the bottom wall 28′ into four isosceles triangular portions 66. The gusset fold lines G extend longitudinally from the top of each gusset panel 38′ to substantially the apex of an associated triangular adjacent portion 66 for enabling the tubular blank bottom wall 28' to be collapsed into the compact generally flattened configuration shown. To facilitate forming a bottom wall 28' of generally planar construction when the blank 22' is expanded, the blank 22' has a fold line L' which extends laterally around the circumference of the blank 22' interconnecting the bottom end of each fold line L and defining the outer periphery of the integral bottom 28'.

While collapsed, each pair of adjacent upper corners 50 of adjacent panels are overlapped and secured together preferably along the angled lines of connection 54 shown in phantom in FIG. 8. Preferably before attaching the top wall 30 to the blank 22', the blank 22' is inverted (not shown) and expanded (FIG. 9) to form the upper shoulder 26. As the panels 36',38' are unfolded, each seam 54 pulls a band of material around the top of blank 22' inwardly to form shoulder 26 while the isosceles triangular portions 66 are drawn upwardly to form bottom 28' into a wall of generally planar construction.

In use, a bag 20 of either blank construction can be expanded by unfolding the gusset panels 38 outwardly and separating the overlying panels 36 from each other. To fill the bag 20, bulk material is introduced into the bag 20 through the inlet spout 34 until the material level within the bag 20 reaches the top edges of panels 36,38. If granular bulk material is being poured into the bag 20, the bag 20 is preferably filled until a cone of material forms within the upraised frustoconical portion of the top wall 30. As the bag 20 is further filled, the sloping interior surfaces of the top wall 30 distribute the granular material into the corners of the bag 20 to more quickly and efficiently fill the bag 20. After the filling operation is complete, the cone may be leveled to substantially completely fill the bag 20.

As is shown in FIG. 1, when the bag 20 is completely filled, it assumes a free-standing, self-supporting generally rectangular solid or cubical configuration which can be stacked side-by-side with other bags and can support another filled bag stacked on its top. The inturned shoulder construction serves to maintain the generally rectangular cross sectional shape of the bag 20, even with another bag stacked thereupon, for maximizing the number of bags of this invention that can be placed side-by-side and one on top of another in a given space for storage. When another bag is stacked on top of the bag 20, it collapses the top wall 28 and rests upon the upper seams 54 and shoulder 26 of the bag 20 further sealing its contents therein while providing stable support for the stacked bag, even if bag 20 is not completely filled. When empty, a bag 20 of this construction is collapsible into a space-saving compact configuration for shipment, storage until later reuse, or disposal.

What is claimed is:

1. A collapsible bag suitable for containing material in bulk comprising:

(a) tubular blank of a flexible material having a circumferentially continuous peripheral wall adapted in use to have the axis of the tubular blank oriented upright and having axially opposite top and bottom blank edges extending transverse to such axis, said blank when collapsed into a compact configuration having six fold lines extending longitudinally from said top to said bottom edges of said blank, with two pairs of said fold lines individually defining laterally opposite outer side edges of a pair of overlying generally rectangular panels, a pair of generally rectangular folded gusset panels being received one between each pair of said overlying rectangular panels and being defined at their overlaid interior side edges by an associated one of the remaining two of said six fold lines, (b) said collapsed blank having four top corners formed one each at the intersection of said blank top edge with each of said outer side edge fold lines, said blank having a line of connection at each of said top corners joining the mutually facing surfaces of each gusset panel and exteriorly adjacent side panel to define four seams extending individually one along each associated said line of connection diagonally across each of said top corners, each said seam being oriented to extend at an angle of about 45 degrees relative to the associated blank top edge and sidewall panel outer side edge, each said seam thereby forming a triangular pleat of overlapped material in the portion of the associated gusset panel and exteriorly adjacent side panel defined between said seam, said blank top edge and associated sidewall panel outer side edge fold, (c) said tubular blank with said seams so formed therein, when turned inside out to invert the same and expanded into upright orientation for use, having a circumferentially continuous sidewall with said four outer side edge fold lines forming said sidewall into a sidewall of generally rectangular configuration in horizontal plan cross section having two pairs of laterally mutually opposed sidewall panels of generally rectangular configuration in elevation, said blank when so inverted causing each said seam to draw inwardly from said continuous sidewall a narrow portion of all of said sidewall panels extending along said blank top edge and thereby forming four inturned shoulder panels defining a circumferentially continuous seam-joined planar top border along the top of said sidewall oriented generally perpendicularly thereto, each said shoulder panel having an outer edge defined by a fold line with the associated one of said sidewall panels and extending horizontally between the intersection of an associated pair of said seams with said outer side edge fold lines of the associated one of said sidewall panels, each said shoulder panel having an inner edge extending parallel to its outer edge between the intersection of said associated pair of said seams with said blank top edge, each said seam when so inverted in turning said blank inside out having the associated pleat portion of said associated gusset panel and exteriorly adjacent side panel extending interiorly of said shoulder top border and said sidewall panels, (d) a bottom wall secured to and extending inwardly from said bottom edge of said blank when expanded, (e) a generally frustoconical top wall vertically opposite said bottom wall joined in underlying relation to and extending inwardly from the interior surface of each of said shoulder panels when said blank is inverted and expanded for use, said top wall having an inlet opening located centrally in said top wall, and (f) an inlet spout attached in underlying relation to the interior surface of said top wall when said blank is inverted and expanded for use, said spout encompassing said inlet opening.

2. The collapsible bulk bag of claim 1 wherein said top wall comprises a separate piece of generally rectangular flexible material attached about its periphery to said shoulder panels of said blank, and at least one pleat in said top wall for forming said top wall into a generally frustoconical shape.

3. The collapsible bulk bag of claim 2 wherein said inlet spout comprises a circumferentially continuous tubular spout of a separate piece of flexible material attached about its periphery to said top wall and encompassing said inlet opening.

4. The collapsible bulk bag of claim 1 also comprising a seam in each bottom corner of each said sidewall panel joining together adjacent bottom corners of mutually adjacent sidewall and gusset panels and drawing the bottom of each said sidewall panel inwardly when said tubular blank is inverted and expanded for use to thereby draw inwardly and form four inturned shoulder panels bordering the bottom of said sidewall to form a planar bottom border having the same construction in mirror image as said circumferentially continuous seam-joined planar top border and likewise oriented perpendicularly to said sidewall and with a like pleat portion at each seam extending interiorly of said shoulder bottom border and said sidewall panels.

5. The collapsible bulk bag of claim 4 wherein said bottom wall comprises a separate piece of flexible material which is attached adjacent its outer periphery in overlying relation to the interior surface of said bottom shoulder border panels when said blank is inverted and expanded for use.

6. The collapsible bulk bag of claim 5 wherein said continuous peripheral wall of said blank is of one piece seamless construction.

7. The collapsible bulk bag of claim 6 wherein each of said interiorly disposed seam-formed pleat portions, one associated with each of said top and bottom border panel seams, are further constructed by being severed between each said seam and associated blank corner prior to inversion of said blank to thereby remove a portion of the overlapped triangular pleat material between each said seam and the associated top and bottom edge and associated side wall panel outer side edge fold to thereby provide said bag in use with a folded-pleat-free interior.

* * * * *